US005367940A

United States Patent [19]

Taylor

[11] Patent Number: 5,367,940

[45] Date of Patent: Nov. 29, 1994

[54] COMBINED MUZZLE BRAKE, MUZZLE CLIMB CONTROLLER AND NOISE REDIRECTOR FOR FIREARMS

[76] Inventor: Henry A. Taylor, P.O. Box 1744, Beeville, Tex. 78102

[21] Appl. No.: 70,896

[22] Filed: Jun. 3, 1993

[51] Int. Cl.[5] ..... F41A 21/36

[52] U.S. Cl. ..... 89/14.3

[58] Field of Search ..... 89/14.2, 14.3, 14.4

[56] References Cited

U.S. PATENT DOCUMENTS

| | | | |
|---|---|---|---|
| 2,322,370 | 6/1943 | Lance | 89/14.3 |
| 2,796,005 | 6/1957 | Shapel | 89/14.3 |
| 2,872,848 | 2/1959 | Schuessler | 89/14.3 |
| 2,916,970 | 12/1959 | Mutter | 89/14.3 |
| 5,105,717 | 4/1992 | Pond | 89/14.3 |

FOREIGN PATENT DOCUMENTS

| | | | |
|---|---|---|---|
| 47405 | 1/1930 | Norway | 89/14.4 |
| 23571 | of 1914 | United Kingdom | 89/14.2 |

*Primary Examiner*—Stephen C. Bentley

*Attorney, Agent, or Firm*—G. Turner Moller

[57] ABSTRACT

A combined muzzle brake and noise redirector is effective to reduce recoil in the range of 25–35% and redirect noise away from the shooter in the range of 35–50%. An outer shell is threaded onto the muzzle end of a firearm and provides a series of inclined openings directed away from the breech end of the firearm. An inner shell provides a central passage for the bullet and a series of openings perpendicular to the central passage. These openings are out of registry and act to redirect noise substantially. Another series of openings in the inner and outer shells are in registry and face upwardly and reduce muzzle climb by directing some propellant gases upwardly.

17 Claims, 2 Drawing Sheets

COMBINED MUZZLE BRAKE, MUZZLE CLIMB CONTROLLER AND NOISE REDIRECTOR FOR FIREARMS

This invention relates to a combined muzzle brake, and noise redirector for firearms and more particularly to such a device having means to minimize muzzle climb.

Muzzle brakes are devices attached to the muzzle of firearms that act to reduce recoil and are broadly known in the prior art. Generally, muzzle brakes are a cylindrical attachment to the muzzle and provide an axial passage for the bullet to pass through and a series of openings perpendicular to the barrel axis and intersecting the axial passage. When the bullet and propellant gases pass from the muzzle, some of the gas impinges on the opening surfaces perpendicular to the barrel axis and produces an axial force in the same direction as the direction of bullet movement. This manifestly reduces the recoil of the firearm. Muzzle brakes are normally designed and used on firearms of substantial power. Typical firearms where a muzzle brake is desirable are rifles such as 0.243, 0.270, 0.30–06, 0.300 magnum, 7 mm Remington magnum caliber and more powerful rifles. Muzzle brakes are commercially available from any firearm catalog, such as Brownells. Muzzle brakes tend to promote greater accuracy because the shooter does not tend to flinch. Muzzle brakes make rifle shooting much more fun because the shooter takes much less of a beating. Muzzle brakes are found in U.S. Pat. Nos. 2,656,637; 2,765,706; 4,322,999; 4,583,445; 4,869,151; 5,036,747 and 5,092,223.

Prior art muzzle brakes typically operate because some of the gas impinges on the opening surfaces perpendicular to the barrel axis and produces an axial force in the same direction as the direction of bullet movement. Thus, the recoil reducing openings deflect propellant gases away from their normal down-the-barrel direction backwards toward the shooter. This directs much of the sound energy of the muzzle blast toward the shooter so that rifles equipped with conventional muzzle brakes appear to the shooter to be louder than the same rifle with no muzzle brake.

Noise suppressors are devices generally, but not necessarily, attached to the muzzle of a firearm to reduce the noise generated when the weapon is fired. Noise suppressors for firearms have been proposed and made for decades. Noise suppressors are very popular on varmint rifles, for example, because one shot drives varmints underground for many hours while noise suppressed rifles can be fired many times before the game becomes wary. The standard noise suppressor was originally proposed by Hiram Maxim and present commercially available silencers are manifest descendants. These suppressors are mounted on the muzzle end of a firearm so the round or shot and all propellant gases pass through the suppressor. This type sound suppressor is basically a muffler.

The device of this invention is not a noise suppressor because the total amount of sound energy is not substantially changed. The device of this invention is more of a noise redirector because the sound energy is directed away from the shooter. Noise suppressors and noise redirectors tend to promote greater accuracy because the shooter does not tend to flinch. Noise suppressors and noise redirectors also have a safety aspect because the loud sounds of firing ultimately impairs hearing.

Another class of devices associated with firearms is used to reduce or minimize muzzle climb. The geometry of rifles and shotguns is that the barrel axis is several inches above the stock end which abuts the shoulder. Similarly, the geometry of pistols is that the barrel axis is several inches above the location where the grip is held. The direction of recoil is coincident with the barrel axis. Thus, a moment is created which rotates the firearm causing the barrel to rise. This can have an effect on accuracy. Muzzle anti-climb devices or techniques are shown in U.S. Pat. Nos. 2,916,970 and 4,322,999.

Other disclosures of interest are found in U.S. Pat. Nos. 1,628,896 and 2,859,444.

So far as is known, there is no device which acts as a muzzle brake, a muzzle climb controller and a noise redirector that is effective to any substantial extent. The muzzle brake/noise redirector of this invention is effective to reduce recoil in the range of 25–35% and is effective to reduce sound energy at the shooter's position in the range of 35–50%. In addition, the muzzle brake/noise redirector of this invention is effective to substantially eliminate muzzle climb.

This performance is caused by a variety of techniques revealed by long experimentation. The bulk of the recoil reduction is caused by openings in an inner sleeve or shell. Escaping propellant gases impinge on part of the surface of these openings and creates a force parallel to the barrel axis and in the direction of bullet movement. This force is in the direction opposite to recoil of the firearm and thus reduces recoil in much the same manner as conventional muzzle brakes.

There are three major sources of noise created upon discharge of a firearm: (1) movement of the mechanism, i.e. firing pin, bolt and the like; (2) movement of the bullet through the air at supersonic velocity; and (3) muzzle blast. The noise redirection aspects of this invention do not affect or reduce noise caused by movement of the firearm mechanism or by travel of the bullet at supersonic velocities. As will become more fully apparent hereinafter, the redirector of this invention reduces noise noticeable to the shooter from muzzle blast for reasons which are only partially understood.

The bulk of the noise redirection is caused by openings in an outer sleeve or shell surrounding the inner shell and by the relationship between the openings in the inner and outer shells. The outer shell openings are inclined relative to the barrel axis away from the breech end of the firearm. Although the inner and outer shell openings are along the same axial extent of the device, the openings are out of registry. Thus, the gas path in the device is (1) perpendicular and away from the barrel axis, (2) helically or arcuately around the inner shell and then (3) along an inclined axis away from the barrel.

Making the openings in the outer shell inclined away from the breech end of the firearm diverts muzzle blast away from the marksman and thus tends to suppress noise at the breech end of the firearm. It is not known why staggering the openings from the inner and outer shells is effective to redirect noise but it is known that it works because early models built with the openings aligned showed no noise redirection.

In summary, this invention comprises a combined muzzle brake and sound redirector for a firearm having a barrel providing an axis, a breech end and a muzzle end, including an outer shell providing a series of first openings providing axes inclined to the barrel axis and defining a series of obtuse angles having one leg on the barrel axis beginning at the muzzle end and a second leg on the opening axis and an inner shell, inside the outer shell, providing an axial passage concentric with the barrel axis for passing a bullet therethrough and a series of second openings opening into the axial passage, the first and second openings residing in common planes perpendicular to the barrel and being out of registry.

It is an object of this invention to provide a combined muzzle brake and noise redirector.

Another object of this invention is to provide a combined muzzle brake and noise redirector having means to reduce muzzle climb.

A further object of this invention is to provide a combined muzzle brake, noise redirector and muzzle climb controller which is simple and inexpensive to manufacture and has no moving parts.

These and other objects of this invention will become more fully apparent as this description proceeds, reference being made to the accompanying drawings and appended claims.

IN THE DRAWINGS

Figures 1, 2, 3:
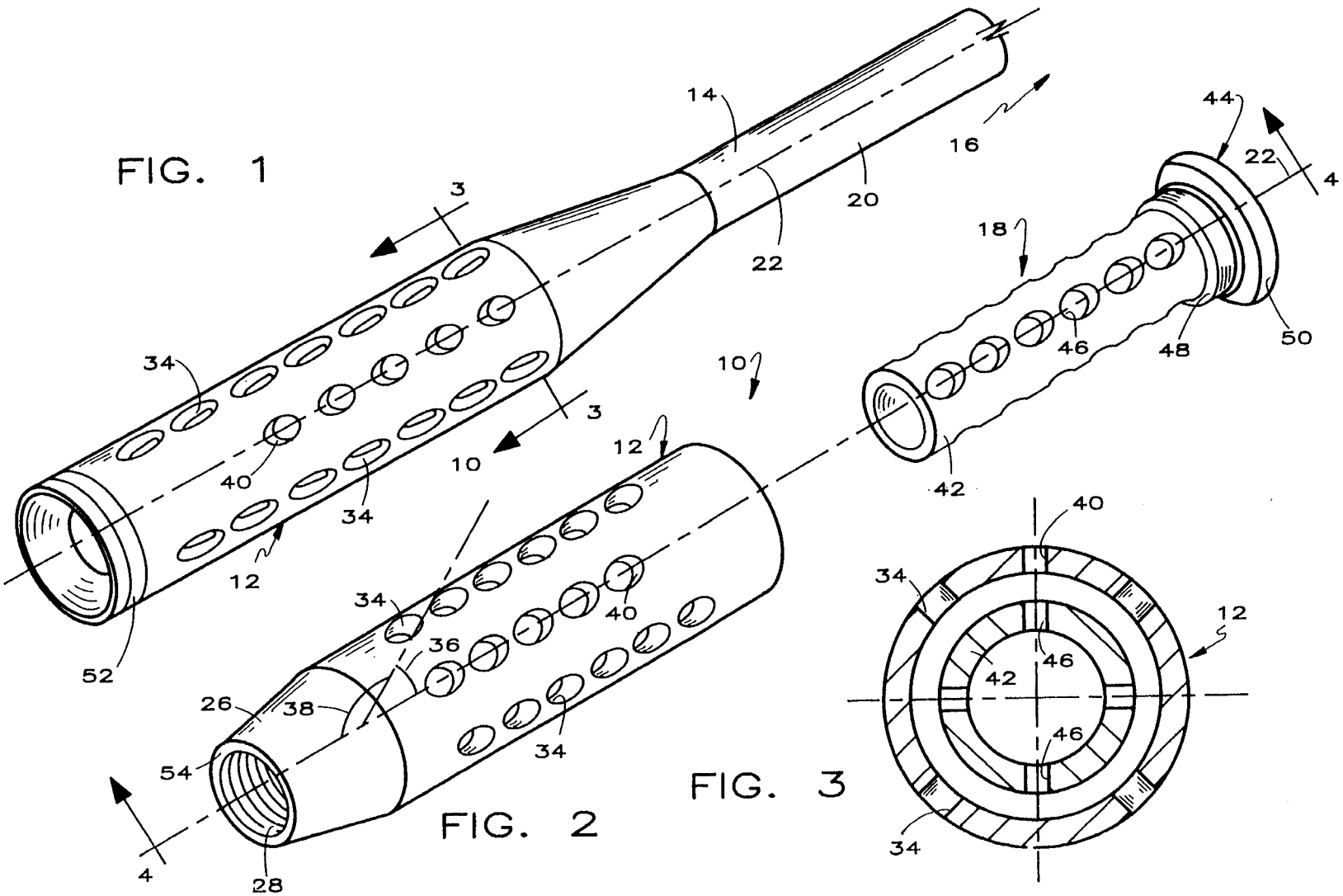
FIG. 1 is an isometric view of a barrel end of a rifle equipped with the muzzle brake/noise redirector of this invention.
FIG. 2 is an exploded isometric view of the muzzle brake/noise redirector of this invention.
FIG. 3 is an enlarged transverse cross-sectional view of the muzzle brake/noise redirector of FIG. 1, taken substantially along line 3—3 thereof as viewed in the direction indicated by the arrows.
Figure 4:
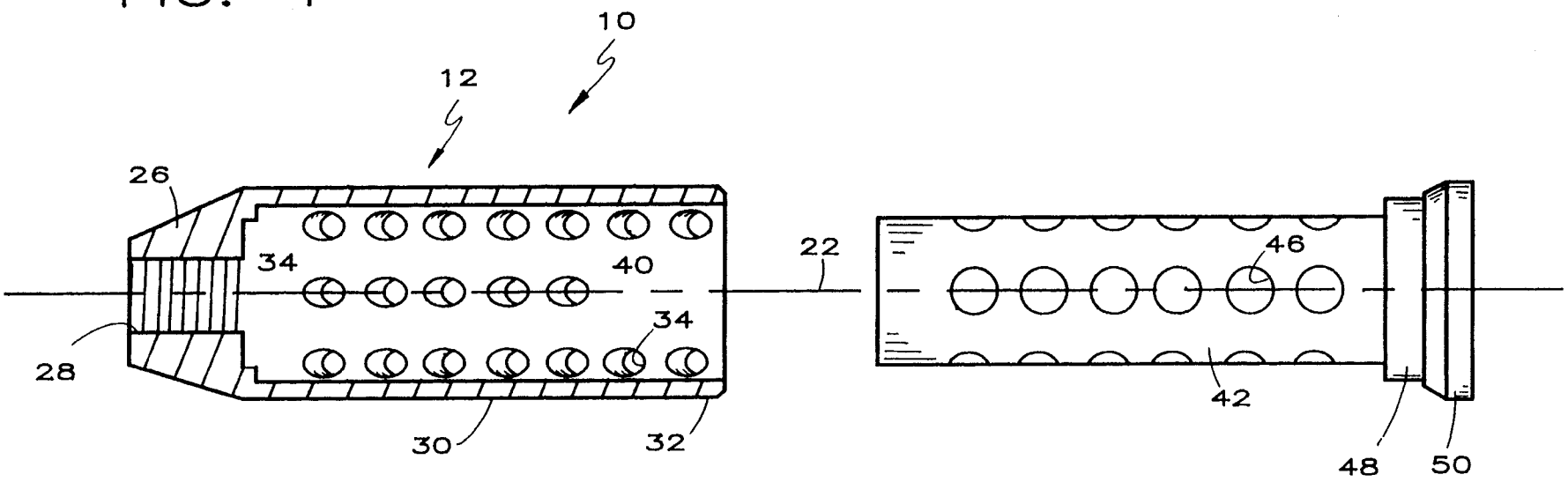
FIG. 4 is a longitudinal cross-sectional view of the muzzle brake/noise redirector of FIG. 1, taken substantially along line 4—4 thereof as viewed in the direction indicated by the arrows.

Referring to FIGS. 1–4, a device 10 of this invention is a combined muzzle brake, noise redirector and muzzle climb controller. The device 10 comprises, as major components, an outer sleeve or shell 12 attached to the muzzle end 14 of a firearm 16 and an inner sleeve or shell 18. The firearm 16 includes a barrel 20 having a barrel axis 22 and a breech end.

The outer shell 12 includes a breech end 26 providing a threaded passage 28 receiving the threaded muzzle end 14 of the firearm 16, a generally cylindrical body 30 and a muzzle end 32. A plurality of rows, preferably four, of openings 34 are aligned parallel to the barrel axis 22 and spaced 90° apart. As shown best in FIG. 3, the rows of openings 34 are at positions corresponding to 1:30, 4:30, 7:30 and 10:30 positions on a clock face. The openings 34 are inclined away from the breech end 26 of the outer shell at an acute angle 36 in the range of 35°–55° with the barrel axis 22 or an obtuse angle 38 in the range of 125°–145° with the barrel axis 22. Preferably, the angles 36, 38 are about 45° and 135° respectively. As will be more fully apparent hereinafter, the openings 34 and their relationship with the inner shell 18 act to reduce the noise generated by firing a round through the barrel 20.

The outer shell 12 also provides another row of openings 40 at a 12 o'clock position. Preferably, the openings 40 are inclined at essentially the same angles as the openings 34. As will be more fully apparent hereinafter, the openings 40 act to minimize or reduce muzzle climb.

The inner shell 18 comprises a tube 42 concentric with the barrel axis 22 and an end disc 44 for purposes more fully apparent hereinafter. The tube 42 provides a plurality of rows, preferably four, of openings 46 transverse to and preferably perpendicular to the barrel axis 22. As shown best in FIG. 3, the rows of openings 46 are positioned at 12, 3, 6 and 9 o'clock on a clock face. Thus, there is only one row of aligned openings 40, 46 at 12 o'clock, the other openings being out of registry. It will be seen that the openings 34, 46 are in the same axial extent of the device 10. From another aspect, the openings 34, 46 lie in common planes perpendicular to the barrel axis 22.

The purpose of the aligned row of openings 40, 46 at 12 o'clock is to reduce or minimize muzzle climb. When a round is fired, the bullet passes through the barrel 20 and into the tube 42. The propellant gases are initially prevented by the bullet from exiting through the end of tube 42 so a significant portion of the propellant gases pass through the aligned openings 40, 46 to exit upwardly in a plane perpendicular to the barrel axis 22. By Newton's third law, this produces a downward force on the end of the barrel 20 that partially or wholly offsets the moment produced by the barrel axis 22 being above the location where the rifle stock abuts the shoulder of the shooter. It will be seen that the openings 40, 46 produce an asymmetric pattern of openings in the outer shell 12 so that more gases are deflected by the device 10 in an upward direction than in any other direction. This asymmetry reduces muzzle climb.

It would seem that the inclination of the openings 34 provides much of the noise redirection. This is only partially true. The inclination of the openings 34 encourages the propellant gases to exit the device 10 in a direction away from the shooter and thereby reduces the back blast of propellant gases toward the shooter. In early models of this invention made with the openings 34 aligned with the openings 46, little if any noise redirection was noted. Only when models were made with the openings 34 out of registry with the openings 46 was it apparent that the firearm appeared less noisy to the shooter. The exact reason for this difference is unknown.

The disc 44 includes an inner cylindrical abutment or shoulder 48 of a size to be closely received inside the inner diameter of the outer shell 12 and an outer cylindrical abutment 50 the same size as the outer diameter of the shell 12. The inner end of the abutment 50 and the muzzle end of the outer shell 12 are beveled to provide a notch to receive weld material securing the inner and outer shells 18, 12 together.

The device 10 may be assembled onto a firearm 16 by securing the inner and outer shells 18, 12 together by a weldment 52. A gun smith fits the device 10 to the particular firearm 16 that the device 10 will be used with. The difficulty is that the device 10 must thread onto the threaded muzzle end 14 of the barrel 20 so the openings 46 are at a 12 o'clock position relative to the barrel 20. This requires that the threads of the passage 28 exactly complement the threads on the barrel 20 which will not occur very often. Thus, the gunsmith who fits the device 10 to the firearm 16 should follow this procedure: (a) thread the device 10 onto the muzzle end 14, (b) tighten with an appropriate wrench, (c) measure the angle from the row of openings 44 to the 12 o'clock position in the direction of threading movement, (d) remove the device 10, (e) calculate the amount of material that must be removed from the face 54 of the device 10 and/or from the shoulder of the barrel 20 to allow the angle to be made up, (f) shorten the device 10 and/or the barrel 20 by grinding or filing the face 54 and/or the barrel 20 to remove the calculated amount of material, (g) blue the device 10 if desired and (h) rethread the device 10 onto the barrel 20 so the openings 46 are at 12 o'clock.

The number, size and spacing of the openings 34, 40, 46 can be changed as desired. The device shown in the drawings is the preferred embodiment for calibers larger than 7 mm and larger. The overall length of this embodiment is 2 29/32". The openings 46 are ¼" in diameter. The cumulative area of the openings 46 is at least four times, and preferably more than ten times, the area of the passage through the tube 42. For example, in the preferred device 10 for a 0.30–06 rifle, the cumulative area of the openings 46 is almost sixteen times the bullet diameter and over fourteen times the tube I.D. The openings 34, 40 are 3/16" in diameter. With a preferred arrangement of seven openings 34 and five openings 40, the cumulative area of the openings 34, 40 is about 75% of the cumulative area of the openings 46. The outside diameter of the shell 18 is 15/16" and the I.D. of the tube 42 varies with caliber. The I.D. of the tube 42 is preferably about 10–20 thousandths of an inch larger than the bullet diameter. For example, with a 0.30–06, the bullet diameter is 0.308 inches and the tube I.D. is preferably 0.323 inches.

The device shown in the drawings with four parallel linear rows of seven openings 34, one shorter row of five openings 40 and four parallel linear rows of six openings 46 provides the best combination of recoil reduction, noise redirection and muzzle climb reduction known at the present time. To produce a preferred device for calibers smaller than 7 mm, the outer shell 12 is simply scaled down. Table I shows results with the device 10 of this invention and without.

TABLE I

| Firearm description | weight lb. | recoil energy ft. lb. | recoil reduction percent | muzzle jump in. | sound level db. | sound level reduc. percent |
|---|---|---|---|---|---|---|
| American Eagle .30-06 (Mauser custom) | | | | | | |
| w/o muzzle brake | 7.8 | 25.7 | | 2.75 | 120 | |
| w/muzzle brake | 8.0 | 19.4 | 24.5 | .25 | 117 | 49.9 |
| Sako 7 mm magnum | | | | | | |
| w/o muzzle brake | 10.1 | 28.3 | | 3.00 | | |
| w/muzzle brake | 10.3 | 20.0 | 29.3 | .25 | | |
| Winchester Model 70 .300 magnum | | | | | | |
| w/o muzzle brake | 9.0 | 44.9 | | 4.00 | 120 | |
| w/muzzle brake | 9.3 | 29.8 | 33.6 | .50 | 118 | 36.9 |
| Winchester Model 70 featherweight .270 | | | | | | |
| w/o muzzle brake | 7.7 | 30.0 | | 3.00 | | |
| w/muzzle brake | 8.0 | 18.2 | 39.3 | .25 | | |

The sound levels were measured with an IVIE PC40 Type 2 sound pressure level meter at a location 24 inches to the right and level with the shooter's ear. This type meter is a sophisticated device used by professional acoustic engineers and is not normally used. Recoil measurements were made using reverse ballistic pendulum device built by applicant and energy calculations were made from these measurements. Weights are accurate to the nearest 1/10th of a pound. Muzzle jump distances are accurate to the nearest ¼ inch. Decibel measurements are to the nearest decibel.

The decibel scale is logarithmic so the difference between 110 and 120 decibels, for example, is a tenfold increase in sound energy. Thus, a decrease from 120 to 117 is substantial.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A combined muzzle brake and sound redirector for a firearm having a barrel having an axis, a breech end and a muzzle end, comprising an outer shell having an upper half and a lower half divided by a plane extending horizontally through the outer shell and including a series of first openings, distributed on both the upper and lower halves, providing axes inclined to the barrel axis and defining a series of obtuse angles having one leg on the barrel axis beginning at the muzzle end and a second leg on the opening axis;

an inner shell, inside the outer shell, having an upper half and a lower half divided by the plane, providing an annular gap between the inner and outer shells, providing an axial passage concentric with the barrel axis for passing a bullet therethrough and providing a series of transverse second openings, distributed on both the upper and lower halves, opening into the axial passage; and means for attaching the inner and outer shells to the muzzle of a firearm;

the first and second openings residing in common planes perpendicular to the barrel and being out of registry.

2. The combination of claim 1 wherein the second openings are generally perpendicular to the barrel axis.

3. The combination of claim 1 wherein the first openings are arranged in a plurality of parallel first rows of axially spaced openings, the second openings are arranged in a plurality of parallel second rows of axially spaced openings, the first and second rows being out of registry.

4. The combination of claim 3 wherein the first and second rows are linear and parallel to the barrel axis.

5. A combined muzzle brake and sound redirector for a firearm having a barrel having an axis, a breech end and a muzzle end, comprising an outer shell including a plurality of parallel first rows of axially spaced first openings providing axes inclined to the barrel axis and defining a series of obtuse angles having one leg on the barrel axis beginning at the muzzle end and a second leg on the opening axis;

an inner shell, inside the outer shell, providing an annular gap between the inner and outer shell, providing an axial passage concentric with the barrel axis for passing a bullet therethrough and providing a plurality of parallel second rows of axially spaced second openings, generally perpendicular to the barrel axis, opening into the axial passage, the first and second rows being linear and parallel to the barrel axis, the first rows being staggered 45° relative to the second rows and first and second rows being out of registry; and means for attaching the inner and outer shells to the muzzle of a firearm;

the first and second openings residing in common planes perpendicular to the barrel and being out of registry.

6. The combination of claim 3 wherein the obtuse angles are in the range of 125°–145°.

7. The combination of claim 4 wherein the obtuse angles are about 135°.

8. A combined muzzle brake, muzzle climb controller and sound redirector for a firearm having a barrel having an axis, a breech end and a muzzle end, comprising an outer shell including a series of first openings providing axes inclined to the barrel axis and defining a series of obtuse angles having one leg on the barrel axis beginning at the muzzle end and a second leg on the opening axis;

an inner shell, inside the outer shell providing an annular gap between the inner and outer shells, providing an axial passage concentric with the barrel axis for passing a bullet therethrough and providing a series of transverse second openings opening into the axial passage; and means for attaching the inner and outer shells to the muzzle of a firearm;

the first and second openings residing in common planes perpendicular to the barrel and being out of registry; and means for minimizing muzzle climb including .a row of third openings in the outer shell and a row of fourth openings in the inner shell, the third and fourth rows being in registry and opening upwardly relative to the barrel axis.

9. The combination of claim 1 wherein the means for connecting the shells to the muzzle of a firearm comprises first means on the outer shell for connecting the outer shell to the muzzle and second means connecting the inner shell to the outer shell.

10. The combination of claim 9 wherein the first means comprises threads on the outer shell and the second means comprises a weldment.

11. The combination of claim 10 wherein the inner shell includes an elongate axially extending tube providing the first openings therein and a disc generally perpendicular to the tube, the weldment connecting the disc to the outer shell.

12. The combination of claim 8 wherein the cumulative area of the second and fourth openings is at least about ten times the area of the axial passage through the inner shell.

13. The combination of claim 12 wherein the cumulative area of the first and third openings is less than the cumulative area of the second and fourth openings.

14. The combination of claim 1 wherein the first openings are distributed substantially symmetrically on the upper and lower halves of the outer shell,

15. The combination of claim 14 wherein the second openings are distributed substantially symmetrically on the upper and lower halves of the inner shell.

16. The combination of claim 1 wherein the first openings are distributed substantially equally on the upper and lower halves of the outer shell.

17. The combination of claim 14 wherein the second openings are distributed substantially equally on the upper and lower halves of the inner shell.

* * * * *